United States Patent [19]

Nicholson

[11] Patent Number: 4,517,755

[45] Date of Patent: May 21, 1985

[54] MULTI-TINED CLAW/RAKE ATTACHMENT

[76] Inventor: Walter Nicholson, Box 917, Port McNeill, B.C., Canada, V0N 2R0

[21] Appl. No.: 515,017

[22] Filed: Jul. 18, 1983

[51] Int. Cl.[3] ..... E02F 3/76

[52] U.S. Cl. ..... 37/117.5; 37/2 R; 37/DIG. 3; 37/DIG. 12; 414/722; 414/740

[58] Field of Search ..... 37/2 R, 2 P, 117.5, 37/DIG. 3, DIG. 12; 414/722, 740

[56] References Cited

U.S. PATENT DOCUMENTS

| | | | |
|---|---|---|---|
| 2,070,964 | 2/1937 | Scott et al. . | |
| 2,612,280 | 9/1952 | Stueland . | |
| 2,932,100 | 4/1960 | Goethe . | |
| 2,950,551 | 8/1960 | Pesce . | |
| 3,081,564 | 3/1963 | Prater . | |
| 3,595,416 | 7/1971 | Perrotti | 37/117.5 X |
| 3,959,900 | 6/1976 | Luck | 37/DIG. 3 X |
| 4,140,348 | 2/1979 | Steada | 37/2 R X |
| 4,283,866 | 8/1981 | Ogawa | 37/117.5 |
| 4,327,509 | 5/1982 | Bean | 37/117.5 |
| 4,407,626 | 10/1983 | Bruckner | 37/117.5 X |

FOREIGN PATENT DOCUMENTS

| | | | |
|---|---|---|---|
| 543725 | 7/1957 | Canada . | |
| 616626 | 3/1961 | Canada . | |
| 2723858 | 12/1977 | Fed. Rep. of Germany . | |
| 2083110 | 3/1982 | United Kingdom | 37/DIG. 3 |

*Primary Examiner*—Edgar S. Burr
*Assistant Examiner*—Moshe I. Cohen
*Attorney, Agent, or Firm*—Majestic, Gallagher, Parsons & Siebert

[57] ABSTRACT

A claw/rake tool attachment for use with a powered digging or material moving machine. The attachment is for clearing undergrowth and timber and consists of spaced parallel tines mounted onto a support means that is affixed to the work arm of a machine. The undergrowth and timer are held by the tines while unwanted material such as soil and the like passes through the space between the tines and is not carried with the undergrowth and timber being cleared.

6 Claims, 6 Drawing Figures

MULTI-TINED CLAW/RAKE ATTACHMENT

FIELD OF THE INVENTION

This invention relates to a multi-tined claw/rake attachment for use with a powered digging or material moving apparatus.

BACKGROUND OF THE INVENTION

A type of attachment tool that is commonly used for the purposes of cutting away and clearing undergrowth and timber in forested areas is a bucket or shovel type attachment which employs forwardly extending tines in conjunction with an enclosed bucket or solid blade proper. Attachments of this type are inefficient in this environment in that much of the dirt, rocks and other unwanted material that is scrapped up along with the undergrowth and timber is trapped in the bucket or shovel proper and is carried along with the undergrowth and timber. This means that an increased number of trips must be made by the vehicle in each situation in order to properly clear the underbrush because the bucket or blade is prematurely filled with unwanted material. As well, the unwanted material adds to the bulk of a stockpile of undergrowth and timber which is built up. It is common when clearing land to burn the undergrowth and timber that is collected during the clearing process. If one uses a known tool attachment the foreign matter collected will hamper the burning action of the fire and may even extinguish the fire.

Another problem with the use of such attachments is that valuable topsoil is necessarily removed from the land when cleared or unevenly distributed on the cleared land.

The applicant has conducted a review of pertinent known apparatus within the field of the invention and has located the following references which disclose relevant equipment:

U.S. Pat. Nos. 2,070,964, Feb. 16, 1937, Scott et al., 2,612,280, Sept. 30, 1952, Stueland, 2,932,100, Apr. 12, 1960, Goethe, 2,950,551, Aug. 30, 1960, Pesce, 3,081,564, Mar. 19, 1963, Prater;

Canadian Pat. Nos. 543,725, July 16, 1957, Wagner, 616,626, Mar. 21, 1961, Wagner;

German Pat. No. 2,723,858, published Dec. 15, 1977.

Most of these references disclose material moving apparatus which employs a "pushing" action. The material is pushed in a direction away from the operator. Moreover, some of the apparatus disclosed is not capable of clutching or lifting the material being cleared.

West German Offenlegungsschrift No. 2,723,858 is prima facie pertinent because it shows a tined claw-like tool attachment. This document discloses an attachment that uses a shock-absorbing mechanism designed for working underground to scrape soil and the like from the walls of tunnels. The shock absorber is employed to prevent damage to the equipment when a rock or root or the like is encountered by the tines. The difficulty of this design when applied to cutting away and clearing undergrowth and timber is that the shock-absorber feature would prevent enough closing pressure being applied on the tines in order to properly hold the undergrowth and timber between the tines and the arm of the material moving apparatus.

As well, the hinging mechanism between the tines and the arm is not designed with lifting of material in mind but is designed to move in conjunction with the shock absorption device. The attachment is not hinged in locations which best permit material such as undergrowth and timber to be held or grasped. The placement of the hinges on the attachment prevents the tines from being moved to a fully closed position, thereby creating further difficulties. If smaller amounts of undergrowth or timber are to be held by the attachment, they will not be held as securely as is possible with an apparatus where the tines can be completely closed.

SUMMARY OF THE INVENTION

The present invention relates to a multi-tined claw/rake attachment for improved cutting away and clearing of undergrowth and timber. It consists of a series of parallel tines for grasping and holding material such as undergrowth or timber between the tines and the arm of a material moving apparatus. The attachment is mounted to the arm of an apparatus so as to swivel in an arc parallel to the arm controlled by the operator of the apparatus. The tines are separated by a space which allows unwanted material such as soil and the like to be sifted through thereby leaving primarily only undergrowth or timber being held by the tines.

IN THE DRAWINGS

An embodiment of the invention will now be described in more detail with reference to the drawings, in which.

DETAILED DESCRIPTION OF AN EMBODIMENT OF THE INVENTION

Figure 1:
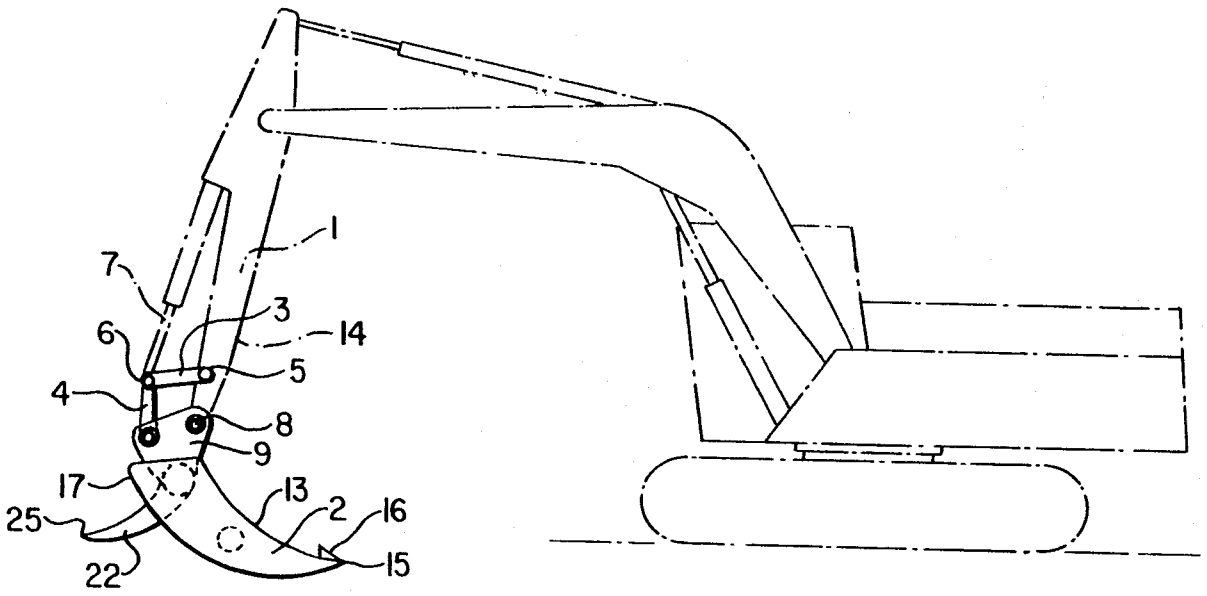
FIG. 1 is a side elevation view of an excavator-type apparatus having an arm on which is mounted a multi-tined claw/rake tool attachment.

For general purposes of illustration, FIG. 1 shows an excavator-type apparatus having an arm 1 on which is mounted a multi-tined claw/rake attachment 2. In general, pivotal connection means is commonly provided for direct pivotal connection of arm 1 of a powered material moving apparatus to a particular tool attachment (see dotted outline). The shape and position of the connecting means so as to properly connect claw/rake attachment 2 onto arm 1 will be apparent to a person skilled in the art.

Figure 2:
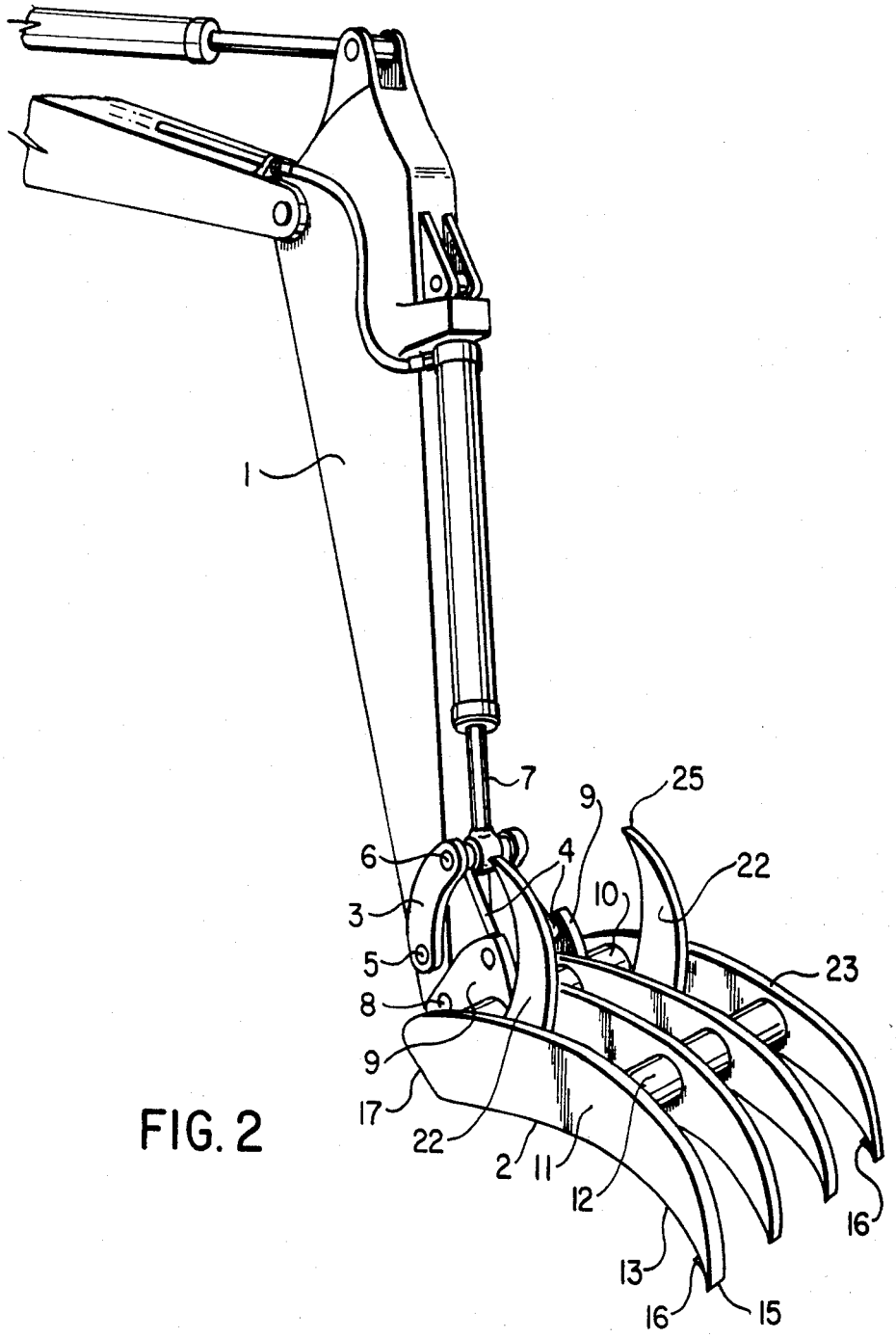
FIG. 2 is a perspective front view of a four-tined claw/rake attachment with the claw in an open position.
Figure 5:
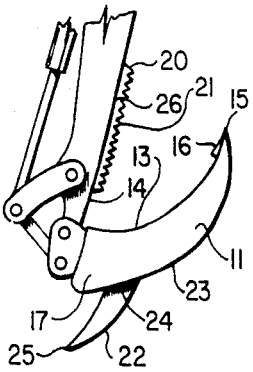
FIG. 5 is a side elevation view of a multi-tined claw/rake attachment in a completely closed position.

FIG. 2 shows in part a common pivotal connection means for an excavator-type apparatus which includes a pair of link arms 3, and a link member 4. Link arms 3 are pivotally connected to arm 1 at pin 5. Link arms 3 are further pivotally connected to link member 4 at pin 6. Motor means 7 (which is typically a doubleacting hydraulic cylinder) is pivotally connected at one end to arm 1 at a point remote from end 8 of arm 1 and pivotal connection pin 5. The other end of motor means 7 is pivotally connected to link member 4 through pin 6. Tool attachments for direct coupling to such common pivotal connection means often provide two pairs of apertured plates perpendicularly affixed to the attachment. The apertures in each pair of plates is axially aligned. In this embodiment, two such apertured plates 9 are rigidly affixed to a lateral support means 10 of claw/rake attachment 2 which can best be seen in FIGS. 2 and 3. Four identically shaped and parallel tines 11 are rigidly affixed to the support means 10 extending in a horizontal position lateral to arm 1 and plates 9. The tines 11 are positioned in a spaced, parallel and approximately equidistant relationship relative to each other. The tines 11 are affixed on support means 10 in a manner which has tines 11 extending in a direction generally opposite or perpendicular to the direction that apertured plates 9 extend from support means 10. The tines 11 are affixed on support means 10 in relation to apertured plates 9 so as to enable the tines 11 to be rotated about support means 10 by operation of motor 7. This rotation provides an opening or closing action which enables undergrowth and the like to be grasped and held between inside edges 13 of tines 11 and inside edge 14 of arm 1 (see FIG. 3 for details) by suitably controlling motor means 7. The claw/rake attachment 2 in closed position is shown in FIG. 5. The tines 11 in various open positions are shown in the other Figures.

Reinforcement means 12 are located between each tine 11. They extend parallel to support means 10 and can be rigidly affixed to each tine at a point between pointed end 15 of tine 11 and support means 10. Reinforcement means 12 are designed to provide optimal support to tines 11 without holding unwanted foreign material in the claw/rake attachment 2. Usually, when underbrush is to be cleared or moved, it is desirable that the soil and smaller materials associated with the underbrush not be carried away with the underbrush and timber, so ample spaces should exist between the tines 11. In some situations, a reinforcement means such as means 12 will not be necessary. Such embodiment is nevertheless considered to be within the spirit and scope of this invention.

Figure 6:
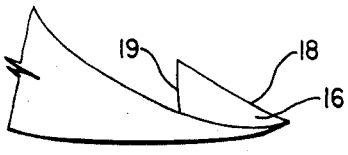
FIG. 6 is a perspective view showing, in detail, a retainer positioned on a tine.

As can best be seen in FIG. 6 (but also shown in FIGS. 1, 2, 3 and 5), retainers 16 can be rigidly affixed to inside edge 13 of pointed end 15 of one or more of tines 11. Generally, retainers 16 are affixed to the two outside tines 11, although when increased holding action is needed, all tines 11 may be equipped with retainer 16. Retainer 16 is primarily triangular or wedge-like in shape and is positioned with broad edge 19 facing the rear end 17 of tine 11. Edge 19 is perpendicular to inside edge 13. Edge 18 slopes towards the pointed end 15 of tine 11 and ultimately terminates smoothly with edge 15. The height of edge 19 is designed so as to efficiently and momentarily hinder the release of the material held by the tines 11 and provides improved control over the placement of the material held by the tines 11.

Figure 3:
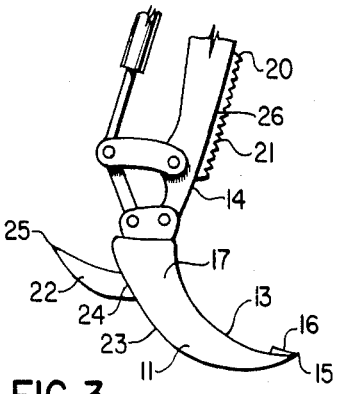
FIG. 3 is a perspective view showing the side of the claw/rake attachment in detail.
Figure 4:
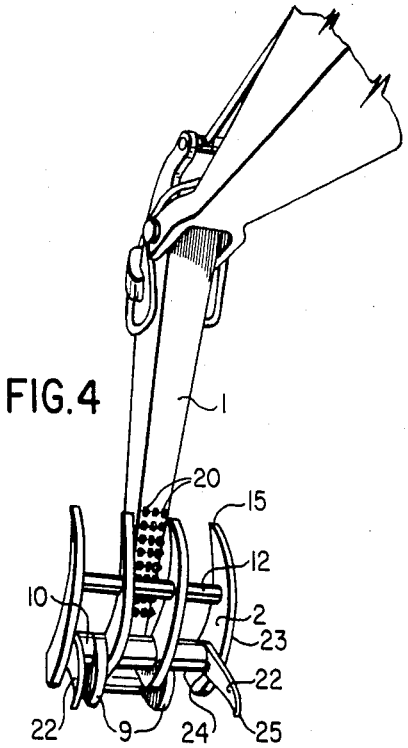
FIG. 4 is a perspective rear view with the claw in a closed position.

Gripping means 20 can be affixed to the side of arm 1 of claw/rake attachment 2 adjacent to the tines 11 in closed position as can best be seen in FIGS. 3 and 4. Gripping means 20 is designed to provide additional support for improved holding of material between tines 11 and arm 1. Gripping means 20 have a flat side 26 affixed to inside edge 14 of arm 1 and sharp tooth serrated side 21 opposite to flat side 26. Gripping means 20 is affixed to arm 1 in such a position that serrated side 21 faces tines 11 when claw/rake 2 is in a closed position as shown in FIG. 5.

One or more pushing claws 22 may be affixed to the underside of one or more tines 11 (the side opposite to edge 13) and positioned near rear end 17 of tines 11. The pushing claws 22 extend in a direction primarily perpendicular to outside edge 23 of tine 11. Inside end 24 of pushing claw 22 is affixed to support means 10. The outside end 25 of pushing claw 22 is pointed with the sides of pushing claw 22 gradually tapering towards outside end 25. The front and rear sides of pushing claw 22 are curved with the curvature in the direction of rear end 17 of tine 11. Pushing claws 22 are designed to enable the operator to move material in a direction away from the material moving apparatus preparatory to being gripped by the tines 11.

As will be apparent to those skilled in the are in the light of the foregoing disclosure, many alterations and modifications are possible in the practice of this invention without departing from the spirit and scope thereof. Accordingly, the scope of the invention is to be construed in accordance with the substance defined by the following claims.

The embodiments of the invention in which an exclusive property or privilege is claimed are defined as follows:

1. A tool attachment for a material clearing apparatus having a working arm comprising:

(a) a plurality of forwardly extending elongated curved tines mounted in parallel relationship to each other with substantially unobstructed spaces therebetween and arranged to extend in a direction away from the end of the work arm; a gripping means fixed to the surface of said work arm which faces toward the material clearing apparatus;

(b) support means affixed to a common end of the tines, said support means being connected to the work arm of said apparatus;

(c) means pivotally joining said support means to the end region of said work arm so as to permit said tines to be moved between an open position in which they extend in a direction away from the end of the working arm and a closed position in which the ends of the tines opposite the support means are proximate to the gripping means carried by the work arm and on the same side of the arm as the material clearing apparatus for holding material between the tines and the gripping means carried by the work arm, said tines and support means pivoting between said open and closed positions as a unit about the end of the work arm and in the same plane as the work arm; and (d) at least one pointed elongated pushing claw protruding from the side of the tines opposite to the material holding side of the tines and curving in a direction opposite the direction in which said tines are curved.

2. An attachment as claimed in claim 1 wherein the tines are curved in the plane in which the tines can be pivoted.

3. An attachment as claimed in claim 1 or 2, wherein tine spacing and reinforcement means are positioned between each of the tines.

4. An attachment as claimed in claim 1, wherein a material retaining device is affixed onto one or more of the ends of said tines opposite said support means.

5. An attachment as claimed in claim 1 wherein the grip enhancement means has a serrated edge on the side away from the side of the work arm.

6. An attachemnt as claimed in claim 1, 2 or 4, wherein at least one pointed pushing claw is affixed to the support means and initially extends in a direction primarily perpendicular to the direction that said tines extend from the support means.

* * * * *